United States Patent [19]

Schwartz et al.

[11] 4,078,783

[45] Mar. 14, 1978

[54] APPARATUS FOR USE IN A BLOOD COLLECTION SYSTEM

[75] Inventors: Robert T. Schwartz, Takoma Park; Marc S. Harrison, Foster, both of Md.

[73] Assignee: American National Red Cross, Washington, D.C.

[21] Appl. No.: 739,859

[22] Filed: Nov. 9, 1976

[51] Int. Cl.[2] ..... A61G 13/00

[52] U.S. Cl. ..... 269/328

[58] Field of Search ..... 269/328, 322; 5/327 R, 5/317 R; 128/77, 133

[56] References Cited

U.S. PATENT DOCUMENTS

| | | | |
|---|---|---|---|
| 1,134,720 | 4/1915 | Bradley | 5/327 R |
| 2,871,074 | 1/1959 | Malerich | 269/328 |
| 3,528,413 | 9/1970 | Aydt | 269/328 |
| 3,614,085 | 10/1971 | Cunningham | 269/328 |
| 3,642,250 | 6/1953 | Kasnowich | 5/317 R |

*Primary Examiner*—Robert C. Watson

*Attorney, Agent, or Firm*—Holman & Stern

[57] ABSTRACT

Apparatus for use in a blood collection system comprising a combined armrest/writing/worksurface adapted to be supported for adjustable movement on a donor lounge. An upper elongated generally horizontally extending trough supports the arm of a donor during venipuncture. An inclined planar writing surface is provided for supporting documents relating to the blood being collected, with a clip means if desired to temporarily retain such documents in position. A further elongated generally horizontally extending trough functions to support various paraphernalia utilized in the collection of blood, including the blood bag, hemostats and various tools, with a tape holding means for rotatably supporting a roll of tape for easy access by a nurse. The armrest/writing/worksurface is rotatably carried on a generally vertically extending upper portion of an elongated standard, with an inclined portion terminating in a lower offset generally vertically extending portion adapted to be rotatably supported on the frame of a donor lounge, as well as vertically adjustable.

22 Claims, 5 Drawing Figures

94
90
20
35
3
96
40
25
2
100
45
3
92
2
98
96
70
30
80
96
94
94
85
82
10

20
45
35
25
35
40
78
78
45
72
72
46
70
76
30
70
30
20
80
74
92
90
94
82

10
20
10
20
20
105
10

APPARATUS FOR USE IN A BLOOD COLLECTION SYSTEM

BACKGROUND OF THE INVENTION

This invention relates to apparatus for use in a blood collection system and relates particularly to certain items useful in a mobile blood collection system adapted for compact storage during transportation from one site to another.

With a mobile blood collection system it is common practice to provide a truck or the like adapted to carry a multiplicity of patient lounges, nurse's chairs and other paraphernalia, all of which must be compactly stored for movement between locations. On site, the lounges are ordinarily arranged so that a single nurse is capable of treating a number of patients simultaneously. Considering the differences in human factors and body mechanics it is important that the individual items in the system, in addition to being adapted for compact storage during transporation, be universal in application to donors of different anatomical proportions. Thus, common equipment must be useful for male and/or female donors of all sizes, shapes and weights. Moreover, such equipment must be readily adaptable for drawing blood from the left or right arm of a patient depending upon the nurse's professional judgement at the time of venipuncture.

In the use of equipment of this type, a variety of requirements must be met. Obviously, the patient or donor must be supported in a comfortable manner for a period of time sufficient to permit the withdrawal of a pint of blood. Although it has been common practice to take blood while the donor's body is in a relatively flat, supine position, under certain circumstances it is desirable to be able to raise the torso and head of the donor, and under other conditions, raising of the donor's legs is necessary. Therefore, a donor lounge should preferably be easily adjusted to any of the foregoing relationships.

Moreover, it is important that the donor's arm be comfortably supported in a position which provides easy access to the nurse while the blood is being withdrawn. In view of the anatomical differences between individual patients, it is necessary that the position of the armrest be extremely easily adjustable in relationship to the donor lounge itself.

Additionally, during blood collection certain documents must be prepared by the nurse and it is important that these documents be easily related to a particular donor for obvious reasons.

Finally, a variety of items must be supported in the immediate location of the donor during the blood collection. For example, the plastic bag receiving the blood must be positioned in a location in which it is visable to the nurse, but preferably out of sight of the donor. Additionally, various tools or other items of equipment such as hemostats, stripping and sealing tools and the like should all be readily available to the nurse. Ordinarily, it is highly desirable that a roll of tape be available for securing a cotton ball or gauze pad over the needle during blood withdrawal.

Thus, it can be seen that it is important to provide an integrated assemblage of elements for use in a blood collection system, particularly a mobile blood collection system. It is, therefore, a primary object of this invention to provide elements of this nature.

A further object of this invention is the provision of a combined armrest/writing/worksurface which is supportable on a donor lounge in a manner that enables great versatility and adjustability in use to accommodate donors of different anatomical proportions.

Another object of this invention is the provision of a mobile lounge for use in combination with an apparatus of the type just described wherein the lounge is symmetrical about a longitudinally extending central axis and, likewise, symmetrical about a transversely extending central axis so that the lounge can be set in any desired location, and used from either side for collecting blood from either arm of a donor.

Still a further object of this invention is to provide a simple and inexpensive unit which is easy to manufacture and maintain and which performs a variety of functions including support of a donor's arm during blood collection with substantially universal adjustment of the position of the arm, means for supporting documents associated with the blood collection in a convenient manner enabling a nurse to enter information on such documents, and a worksurface adapted to support the blood bag and other paraphernalia, including a roll of surgical tape or the like, during the blood collection process.

Other and further objects reside in the combination of elements, arrangement of parts, and features of construction all as will be pointed out in great detail hereinafter, or will be obvious from the following detailed description of the invention, which makes reference to the accompanying drawings wherein:

FIG. 5 is a schematic plan view showing one manner in which a plurality of such units could be arranged for attendance by a single nurse or the like.

Like reference characters refer to like parts throughout the several views of the drawings.

Figure 1:
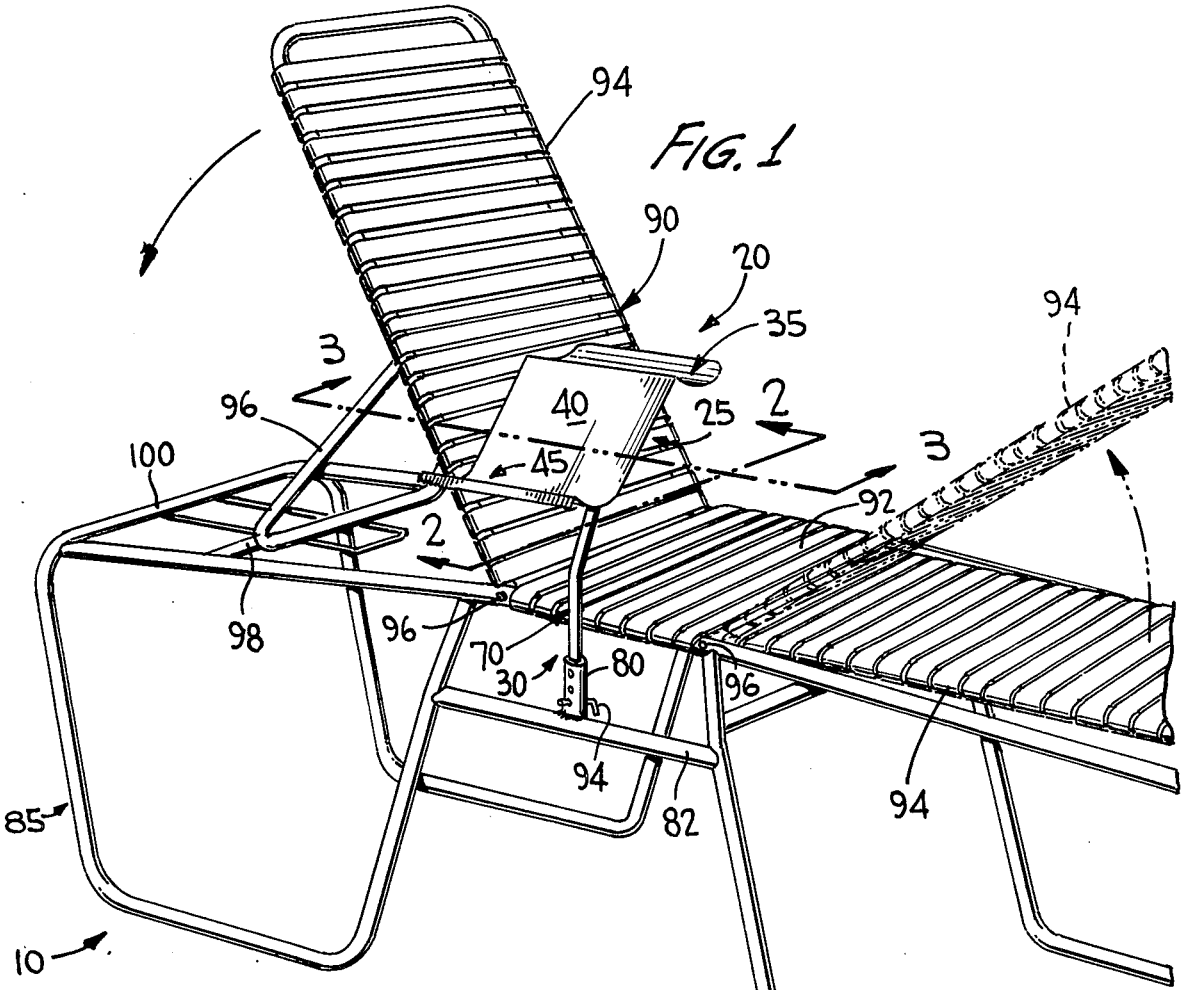
FIG. 1 is a perspective view of one embodiment of a mobile lounge incorporating a combined armrest/writing/worksurface according to the instant inventive concepts, with portions being broken away for illustrative convenience.
Figure 2:
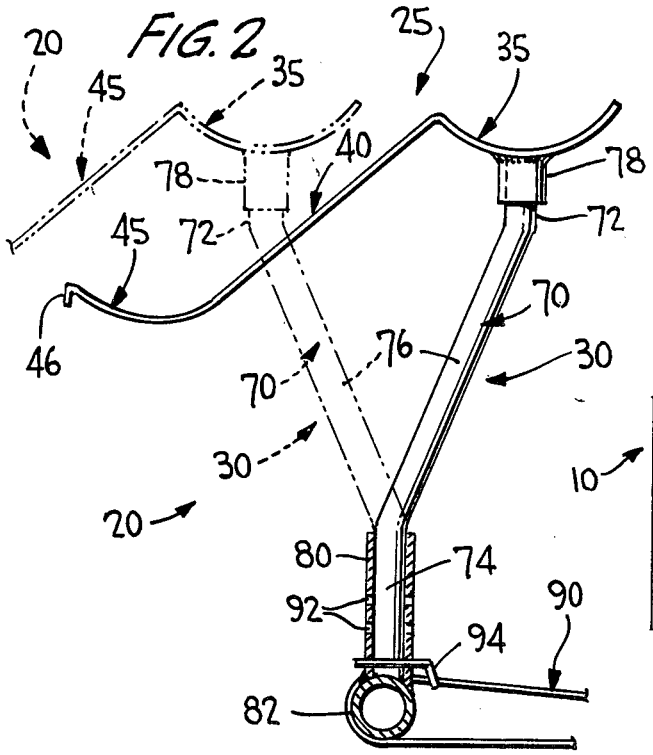
FIG. 2 is an enlarged side view, taken along the lines 2—2 of FIG. 1, and particularly showing the details of the combined armrest/writing/worksurface assembly, with an alternate position of this mechanism shown in dotted lines.

Referring now to the drawings in general, and more particularly to FIG. 1, one embodiment of a mobile lounge or donor support combined with an armrest/writing/worksurface unit according to the instant inventive concepts is generally shown. The mobile lounge or support itself is designated generally by the reference numeral 10 and the armrest/writing/worksurface unit is designated generally by the reference numeral 20.

Reference is made particularly to FIGS. 1–4 for a more detailed description of the unit 20 which comprises a combined armrest/writing/worksurface means designated generally by the reference numeral 25 and a supporting means designated generally by the reference numeral 30 therefor.

The combined armrest/writing/worksurface means 25 include portions defining an armrest means 35 in the form of an elongated, generally horizontally extending, first or upper trough means for supporting the arm of a donor in an obvious manner. The armrest means 35 preferably has relatively smoothly curved corners 36 to protect a donor against injury.

Figure 3:
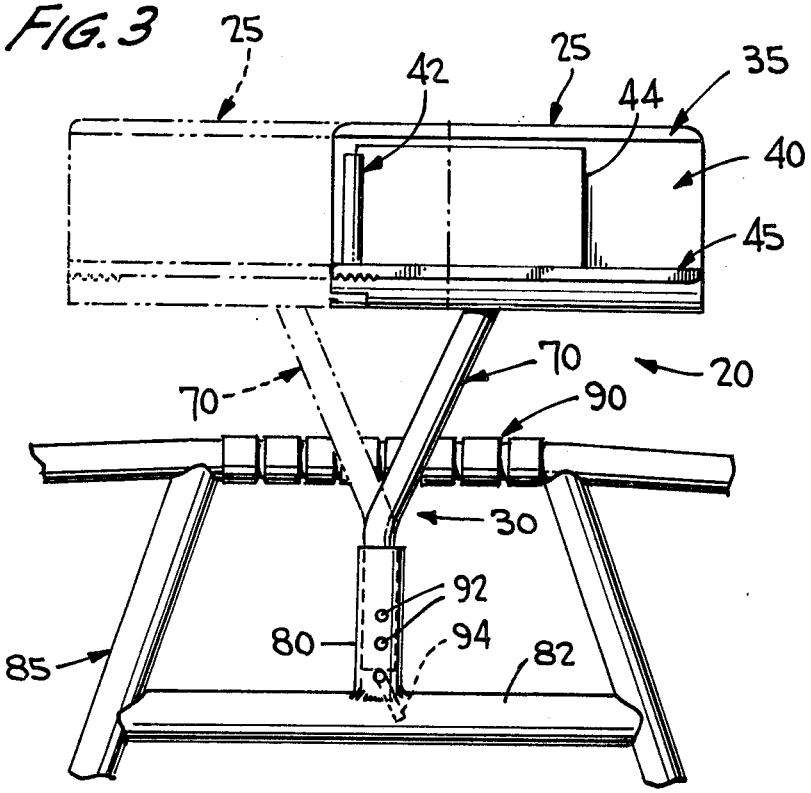
FIG. 3 is a fragmentary elevational view taken substantially along lines 3—3 of FIG. 1, with an alternate position of the armrest/writing/worksurface assembly shown in dotted lines.
Figure 4:
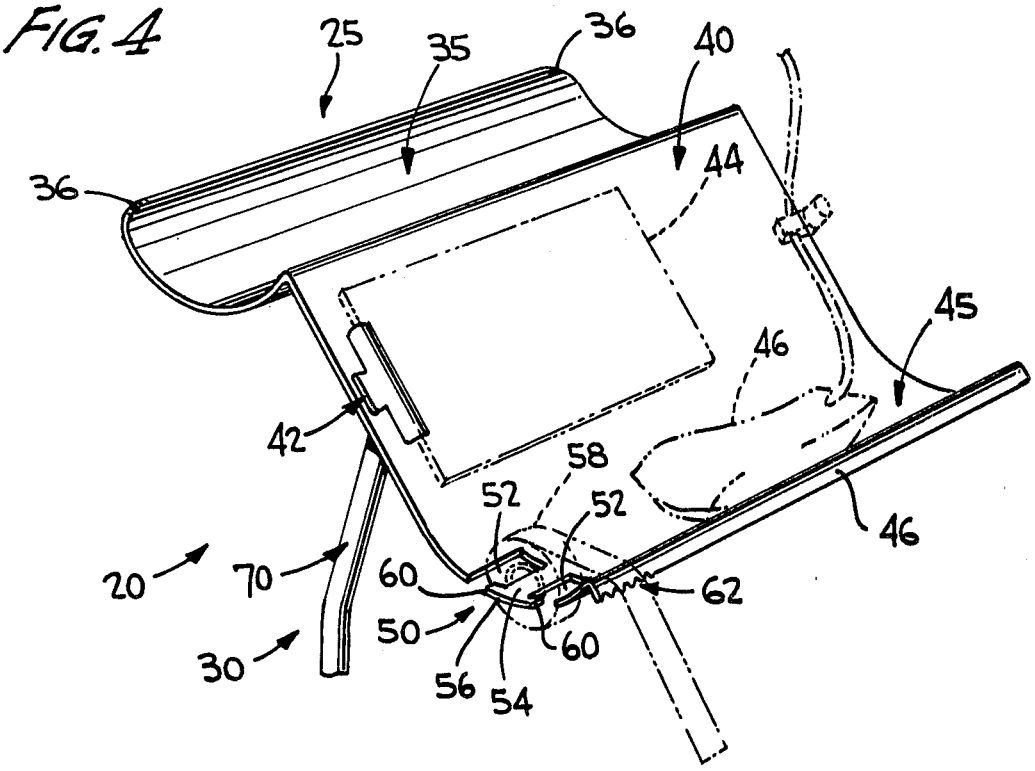
FIG. 4 is an enlarged perspective view of the foregoing assembly illustrating in dotted lines the manner in which a blood collection bag, certain documents and a roll of tape would be supported thereby.

Depending from one edge of the armrest means 35 is a writing surface means 40 in the form of an inclined planar surface, preferably with a conventional clip means such as shown particularly in FIGS. 3 and 4 at 42 secured thereto for temporarily retaining documents illustratively shown at 44 in a manner so that a nurse or the like can enter information thereon prior to, and during, blood collection.

At the lower end of the writing surface means 40 is a worksurface means 45 in the form of a second or lower elongated, generally horizontally extending, trough, preferably having a downturned lip or flange 46. This trough 45 is adapted to support a blood collection bag such as shown in dotted lines at 46 in FIG. 4 and, also, is capable of supporting other paraphernalia utilized during the blood collection process in a convenient manner.

Preferably, a tape holding means 50 is defined as part of the worksurface means 45 by a pair of spaced indentations 52 along one edge of the lower trough means defining between them an elongated tape supporting element 54 having a free end 56 for the reception of a roll tape, shown in dotted lines at 58 in FIG. 4, thereover, preferably with a tape retaining means in the form of a pair of small outstanding protuberances 60 to assist in temporarily securing a roll of tape on the element 56. Normally, the tape is wound on a somewhat flexible core element which may be made of a paperboard, plastic or the like, and which is capable of being flexed sufficiently to override the protuberances 60, although once on the tape supporting element 54, the protuberances 60 normally retain the roll of tape 58 thereon for rotation with respect thereto.

This type of tape utilized obviously forms no part of the instant inventive concepts. Certain commercially available tapes useful in blood collection systems are transversely weakened at selected locations, such as by perforations or the like, to simplify selectively severing a particular length of tape from a roll. If tape of this nature is not utilized, a tape cutting means shown as a serrated edge 62 may be defined on the flange 46 to facilitate selectively severing lengths of tape from the roll.

It will be seen that the combined armrest/writing-/worksurface unit 20 is preferably formed of a single element bent to a desired shape. Any suitable material may be utilized for this element, including various plastics or metals, although aluminum has been found particularly useful.

The supporting means 30 includes an elongated standard means 70, such as a tubular member, preferably formed of stainless steel, an upper, generally vertically extending portion 72, a lower generally vertically extending portion 74 and an inclined intermediate connecting portion 76. Relatively universal adjustment of the positioning of the unit 25 is provided by a boss 78 secured to the undersurface of the armrest trough 35 and rotatably receiving the upper portion 72 of the standard means 70. Similarly, an upstanding tubular element 80 is provided on a crossbar 82 forming part of the frame means 85 of the mobile lounge 10, this tubular element 80 defining a vertically extending bore adapted to rotatably receive the lower portion 74 of the standard means 70. The offset vertical axes of the upper and lower portions 72, 74 of the standard means 70 enables substantial adjustment in the positioning of the unit 20 relative to the donor support means designated generally by the reference numeral 90 of the mobile lounge 10. Specifically, by reference to FIGS. 2 and 3, it will be seen how the unit 25 can be moved closer to, or farther away from, the donor support means 90 (note FIG. 2) and how the unit 25 can be moved longitudinally of the transversely extending central axis of the donor lounge 10 (note FIG. 3), with any combination of these adjustments also being possible to accommodate donors of different anatomical proportions.

Additionally, the standard means 70 is vertically adjustable relative to the donor support means 90 by virtue of a multiplicity of transversely extending, vertically spaced, pairs of horizontally aligned apertures 92 with a pin means 94 selectively insertable in a pair of such apertures to underly the lower portions 74 of the standard means 70. Note particularly FIGS. 1–3.

Thus, the various adjustable means referred to above enable substantially universal orientation of the unit 25 relative to a donor on the donor support means 90 of the mobile lounge 10.

With reference to the mobile lounge 10, it will be seen that the preferred embodiment shown in the drawings is substantially symmetrical about a longitudinally extending central axis and a transversely extending central axis (not shown). The donor support means 90 comprises a generally horizontally extending central section 92 fixed relative to the frame means 85 with a pair of mirror-image elongated end or wing section 94 hingedly secured in a conventional manner at 96 to the frame means adjacent to the end edges of the central section 92 for selective adjustment of the inclination of each of the end sections 94 between a fully flat position, an intermediate raised position and a fully raised position, with appropriate pivotal supports such as shown at 96 and stop elements such as shown at 98, 100 adapted to retain a particular end section 94 in a preselected angular relationship.

Figure 5:
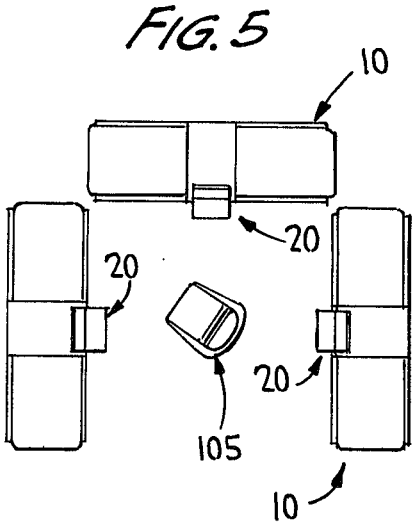

By reference to FIG. 5, one arrangement for the basic elements in a mobile blood collection set-up is shown wherein three mobile lounges 10 are arranged in a U-shaped fashion with a nurse's chair 105 centrally thereof. It can be seen that each of the donor lounges 10 incorporates a combined armrest/writing/worksurface unit 20 on the side juxtaposed to the nurse. By selective orientation of a donor on each lounge, either arm can be utilized for blood collection without rearranging the lounges themself. In this manner, a single nurse can accommodate three donors and simultaneously collect blood and attend to the donors in a simple and convenient manner both for the nurse and for the donors.

The donor lounges 10 are adapted to be stacked for compactness during storage and transportation, with the units 20 removed from their engagement in the tubular elements 80 and separately stored.

The frame means 85 of the donor lounge 10 may be formed of any conventional material, aluminum or steel tubing being preferred, with plastic ribbing or the like as is conventional covering the donor supporting means 90 for comfort and wear.

Thus, it will now be seen that there is herein provided improved apparatus for use in a blood collection system, particularly a mobile blood collection system, which satisfies all of the objects of the instant inventive concepts as pointed out above, and others, including many advantages of great practical utility and commercial importance.

The Embodiments of the invention in which an exclusive property or privilege is claimed are defined as follows:

1. Apparatus for use in a blood collection system comprising:

a combined armrest/writing/worksurface means; and supporting means therefor;

said armrest/writing/worksurface means including:

portions defining an armrest means for supporting an arm of a blood donor during venipuncture, said armrest means comprising elongated, generally horizontally extending, first trough means for supporting an arm of a donor;

further portions defining a writing surface means for supporting documents relating to the blood being collected; and still further portions defining a worksurface means for supporting paraphernalia utilized in the collection of blood, said worksurface means comprising elongated, generally horizontally extending, second trough means spaced below said first trough means;

said supporting means including:

standard means for supporting said armrest/writing-/worksurface means; and adjustable means for varying the position of said armrest/writing/worksurface means relative to a donor.

2. The apparatus of claim 1 wherein said armrest/-writing/worksurface means is a single element including said portions defining said armrest means, said writing surface means and said worksurface means.

3. The apparatus of claim 1 wherein said writing surface means comprises an inclined planar surface for supporting documents relating to the blood being collected.

4. The apparatus of claim 3 further including clip means carried by said inclined surface for removably attaching the documents to said inclined surface.

5. The apparatus of claim 1 further including tape holding means for rotatably supporting a roll of tape utilized in the collection of blood.

6. The apparatus of claim 5 further including tape cutting means for selectively severing lengths of tape from a roll rotatably supported by said tape holding means.

7. Apparatus for use in a blood collection system comprising:

a combined armrest/writing/worksurface means; and supporting means therefor;

portions defining an armrest means for supporting an arm of a blood donor during venipuncture;

further portions defining a writing surface means for supporting documents relating to the blood being collected; and still further portions defining a worksurface means for supporting paraphernalia utilized in the collection of blood;

said supporting means including:

standard means for supporting said armrest/writing-/worksurface means; and adjustable means for varying the position of said armrest/writing/worksurface means relative to a donor, said armrest/writing/worksurface means comprising an upper elongated, generally horizontally extending trough means defining said armrest means, an intermediate inclined planar surface defining said writing surface means, and a lower elongated, generally horizontally extending trough means defining said worksurface means.

8. The apparatus of claim 7 wherein said armrest/-writing/worksurface means is a single element.

9. The apparatus of claim 8 further including clip means carried by said inclined surface for removably attaching the documents to said inclined surface.

10. The apparatus of claim 8 further includng tape holding means for rotatably supporting a roll of tape utilized in the collection of blood.

11. The apparatus of claim 10 wherein said tape holding means comprises portions of said lower trough means defining a pair of spaced indentations along one edge of said lower trough means with a tape supporting element defined therebetween, said tape supporting element having a free end for reception of a roll of tape thereover.

12. The apparatus of claim 11 further including tape retaining means on said free end of said tape supporting element, said tape retaining means comprising a pair of outstanding protuberances on said free end of said tape supporting element.

13. The apparatus of claim 10 further including portions of said lower trough means below said tape holding means defining tape cutting means for selectively severing lengths of tape from a roll.

14. The apparatus of claim 13 wherein said tape cutting means comprises a serrated edge defined by portions of said lower trough means below said tape holding means.

15. The apparatus of claim 7 wherein said standard means comprises an elongated element having an upper, generally vertically extending portion, a lower, generally vertically extending portion, and an inclined intermediate connecting portion, said adjustable means including means securing said upper portion of said standard means to the undersurface of said armrest/writing-/worksurface means for relative rotation about a first vertical axis, said lower portion of said standard means being adapted to be secured to portions of a donor support for relative rotation about a second vertical axis offset from said first vertical axis, and relative vertical adjustment.

16. In combination, a donor support comprising frame means and donor support means carried by said frame means, and an apparatus for use in a blood collection system carried by said frame means in juxtaposition to said donor support means, said apparatus for use in a blood collection system comprising:

a combined armrest/writing/worksurface means; and supporting means therefor;

said armrest/writing/worksurface means including:

portions defining an armrest means for supporting an arm of a blood donor during venipuncture;

further portions defining a writing surface means for supporting documents relating to the blood being collected; and still further portions defining a worksurface means for supporting paraphernalia utilized in the collection of blood;

said supporting means including:

standard means for supporting said armrest/writing-/worksurface means; and adjustable means for varying the position of said armrest/writing/worksurface means relative to a donor, said armrest/writing/worksurface means comprising an upper elongated, generally horizontally extending trough means defining said armrest means, an intermediate inclined planar surface defining said writing surface means, and a lower elongated, generally horizontally extending trough means defining said worksurface means.

17. The combination of claim 16 wherein said donor support includes a longitudinally extending central axis and a transversely extending central axis, said apparatus being carried by said frame means on said transversely extending central axis, spaced laterally from said longitudinally extending central axis.

18. The combination of claim 17 wherein said donor support is symmetrical about said longitudinally extending and transversely extending central axes.

19. The combination of claim 18 wherein said donor support means comprises a generally horizontally extending central section fixed relative to said frame means and including a pair of longitudinally extending side edges and a pair of transversely extending end edges, and a pair of elongated end sections, generally horizontally extending hinge means connecting each of said end sections to said frame means adjacent said end edges of said central section for selective adjustment of the inclination of each of said end sections relative to said central section, and means for supporting each end section at a selected inclination.

20. The combination of claim 19 wherein said standard means of said apparatus comprises an elongated element having an upper, generally vertically extending portion, a lower, generally vertically extending portion, and an inclined intermediate connecting portion, said adjustable means including upper adjustable means securing said upper portion of said standard means to the undersurface of said armrest/writing/worksurface means for relative rotation about a first vertical axis, and lower adjustable means securing said lower portion of said standard means to a portion of said frame means of said donor support for relative rotation about a second vertical axis offset from said first vertical axis.

21. The combination of claim 20 wherein said frame means includes lower adjustable means on said transversely extending axis on each side of said longitudinally extending axis for support of said apparatus on either side of said donor support.

22. The combination of claim 20 wherein said lower adjustable means comprises an upstanding tubular element defining a bore for rotatably receiving said lower portion of said standard means of said apparatus, a multiplicity of transversely extending, vertically spaced, pairs of horizontally aligned apertures defined in said tubular element, and pin means insertable through a selected pair of apertures and adapted to underly said lower portion of said standard means of said apparatus, thereby permitting vertical adjustability of said armrest/writing/worksurface means.

* * * * *